US008983336B2

(12) United States Patent
Kojima et al.

(10) Patent No.: US 8,983,336 B2
(45) Date of Patent: Mar. 17, 2015

(54) CLEANING BLADE WITH A CONTACTING LAYER, CLEANING DEVICE, PROCESS CARTRIDGE AND IMAGE FORMING APPARATUS

(71) Applicant: Fuji Xerox Co., Ltd., Tokyo (JP)

(72) Inventors: Noriaki Kojima, Kanagawa (JP); Yoshinori Takahashi, Kanagawa (JP); Kei Tanaka, Kanagawa (JP); Tsutomu Sugimoto, Kanagawa (JP); Daisuke Tano, Kanagawa (JP); Masato Ono, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 33 days.

(21) Appl. No.: 13/862,769

(22) Filed: Apr. 15, 2013

(65) Prior Publication Data

US 2014/0086624 A1 Mar. 27, 2014

(30) Foreign Application Priority Data

Sep. 25, 2012 (JP) ..... 2012-210549

(51) Int. Cl.
*G03G 21/00* (2006.01)
*G03G 21/18* (2006.01)

(52) U.S. Cl.
CPC ..... *G03G 21/0017* (2013.01); *G03G 21/1814* (2013.01)
USPC ..... 399/111; 399/350

(58) Field of Classification Search
USPC ..... 399/111, 350
See application file for complete search history.

(56) References Cited

U.S. PATENT DOCUMENTS

2006/0216526 A1* 9/2006 Tomiyama et al. ..... 428/423.1
2011/0243624 A1* 10/2011 Yamamoto et al. ..... 399/350
2014/0086655 A1* 3/2014 Kojima et al. ..... 399/350

FOREIGN PATENT DOCUMENTS

JP A-2004-287102 10/2004
JP A-2007-030385 2/2007
JP A-2009-300551 12/2009

* cited by examiner

*Primary Examiner* — Quana M Grainger
(74) *Attorney, Agent, or Firm* — Oliff PLC

(57) ABSTRACT

Provided is a cleaning blade including a contacting corner portion which comes in contact with and cleans a surface of a member to be cleaned moving relative to the cleaning blade, a tip surface which configures one side with the contacting corner portion and faces an upstream side of the surface moving direction, a ventral surface which configures one side with the contacting corner portion and faces a downstream side, and a rear surface which shares one side with the tip surface and opposes the ventral surface.

4 Claims, 10 Drawing Sheets

CLEANING BLADE WITH A CONTACTING LAYER, CLEANING DEVICE, PROCESS CARTRIDGE AND IMAGE FORMING APPARATUS

CROSS-REFERENCE TO RELATED APPLICATIONS

This application is based on and claims priority under 35 USC 119 from Japanese Patent Application No. 2012-210549 filed Sep. 25, 2012.

BACKGROUND (i) Technical Field

The present invention relates to a cleaning blade, a cleaning device, a process cartridge, and an image forming apparatus.

(ii) Related Art

In the related art, in a copier, a printer, a facsimile and the like of an electrophotographic system, a cleaning blade has been used as a cleaning unit for removing remaining toner or the like on a surface of an image holding member such as a photoreceptor.

SUMMARY

According to an aspect of the invention, there is provided a cleaning blade including: a contacting corner portion which comes in contact with and cleans a surface of a member to be cleaned moving relative to the cleaning blade; a tip surface which configures one side with the contacting corner portion and faces an upstream side of the surface moving direction; a ventral surface which configures one side with the contacting corner portion and faces a downstream side; and a rear surface which shares one side with the tip surface and opposes the ventral surface, wherein, when a direction parallel with the contacting corner portion is set as a short direction, a direction of a side formed from the contacting corner portion to the tip surface is set as a longitudinal direction, and a direction of a side formed from the contacting corner portion to the ventral surface is set as a longitudinal direction, the cleaning blade further includes a contacting layer which configures a portion including the contacting corner portion, and in which a region where a ratio (T/W) of a longitudinal direction maximum length (T) and a longitudinal direction maximum length (N) satisfies a relationship equal to or less than 0.35, is equal to or more than 95% in a region contributing for cleaning in the short direction, and dynamic ultra microhardness is from 0.25 to 0.65, a rear surface layer which covers the rear surface side of the contacting layer in the longitudinal direction and the side opposite to the tip surface in the longitudinal direction and is formed of a material different from the contacting layer, and a supporting member which is adhered to the rear surface and is disposed so that a length from an end portion on the tip surface side in the adhered state to an end portion of the rear surface on the tip surface side is longer than the maximum length of the contacting layer in the longitudinal direction.

BRIEF DESCRIPTION OF THE DRAWINGS

Exemplary embodiments of the present invention will be described in detail based on the following figures, wherein.

DETAILED DESCRIPTION

Hereinafter, exemplary embodiments of a cleaning blade, a cleaning device, a process cartridge, and an image forming apparatus of exemplary embodiments of the invention will be described in detail.

Cleaning Blade

The cleaning blade according to the exemplary embodiment includes a contacting corner portion which comes in contact with a driving member to be cleaned to clean a surface of the member to be cleaned, a tip surface which configures one side with the contacting corner portion and faces upstream side of the surface moving direction, a ventral surface which configures one side with the contacting corner portion and faces downstream side of the surface moving direction, and a rear surface which shares one side with the tip surface and opposes the ventral surface. In addition, in this specification, a direction parallel with the contacting corner portion is set as a short direction, a direction of a side formed from the contacting corner portion to the tip surface is set as a longitudinal direction, and a direction of a side formed from the contacting corner portion to the ventral surface is set as a longitudinal direction.

The cleaning blade according to the exemplary embodiment includes a contacting layer (hereinafter, also referred to as an "edge member") configuring a portion including the contacting corner portion, a rear surface layer (hereinafter, also referred to as a "rear surface member") which covers the rear surface side of the contacting layer (edge member) in the longitudinal direction and the side opposite to the tip surface in the longitudinal direction and is configured of a material different from the contacting layer, and a supporting member (hereinafter, also referred to as a "holder") which is adhered to the rear surface.

In the contacting layer (edge member), dynamic ultra microhardness is from 0.25 to 0.65. In addition, in the shape thereof, a region where a ratio (T/W) of a longitudinal direction maximum length (T) and a longitudinal direction maximum length (W) satisfies a relationship equal to or less than 0.35, is equal to or more than 95% in a region contributing for cleaning in the short direction. The region where the ratio (T/W) satisfies a relationship equal to or less than 0.35 is preferable to be closer to 100% in the range contributing for cleaning in the short direction.

Further, the supporting member (holder) is disposed so that a length from an end portion of the rear surface on the tip surface side to an end portion of the supporting member on the tip surface side in a state of being adhered to the rear surface, that is, a length (so-called blade free length) of a region not supported by the supporting member (holder) on the rear surface in the longitudinal direction, is longer than the maximum length of the contacting layer (edge member) in the longitudinal direction.

Herein, the cleaning blade according to the exemplary embodiment will be described in detail with reference to the drawings.

Figure 1:
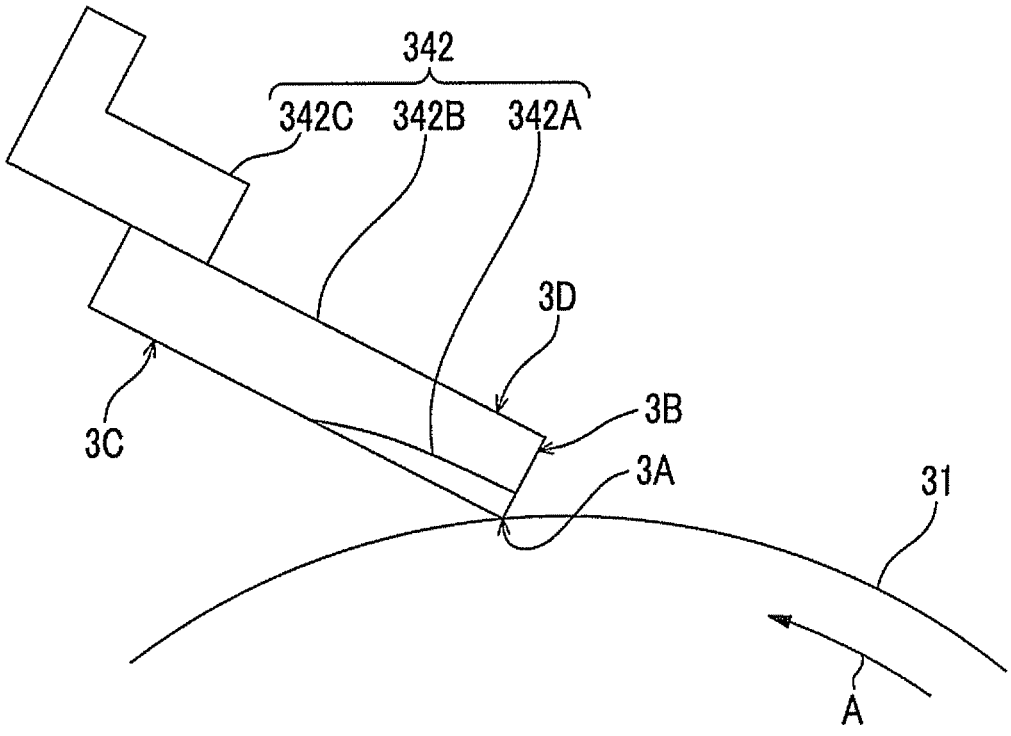
FIG. 1 is a side view showing a state where a cleaning blade according to an exemplary embodiment comes in contact with a surface of a member to be cleaned.

FIG. 1 is a side view showing a state where the cleaning blade according to the exemplary embodiment comes in contact with a surface of a photoreceptor drum (electrophotographic photoreceptor) which is an example of a member to be cleaned.

A cleaning blade 342 shown in FIG. 1 includes a contacting corner portion 3A which comes in contact with the photoreceptor drum 31 driving in an arrow A direction to clean the surface of the photoreceptor drum 31, a tip surface 3B which configures one side with the contacting corner portion 3A and faces the upstream side of the surface moving direction (arrow A direction), a ventral surface 3C which configures one side with the contacting corner portion 3A and faces the downstream side of the surface moving direction (arrow A direction), and a rear surface 3D which shares one side with the tip surface 3B and opposes the ventral surface 3C. In addition, a direction parallel with the contacting corner portion 3A (that is, direction from the front to the inside in FIG. 1) is set as a short direction, a direction of a side formed from the contacting corner portion 3A to the tip surface 3B is set as a longitudinal direction, and a direction of a side formed from the contacting corner portion 3A to the ventral surface 3C is set as a longitudinal direction.

The cleaning blade 342 includes a contacting layer (edge member) 342A configuring a portion which comes in contact with the photoreceptor drum 31, that is, a portion including the contacting corner portion 3A, a rear surface layer (rear surface member) 342B which covers the rear surface 3D side of the contacting layer 342A in the longitudinal direction and the side opposite to the tip surface 3B in the longitudinal direction, and a supporting member (holder) 342C which is adhered to the rear surface 3D.

Figure 2:
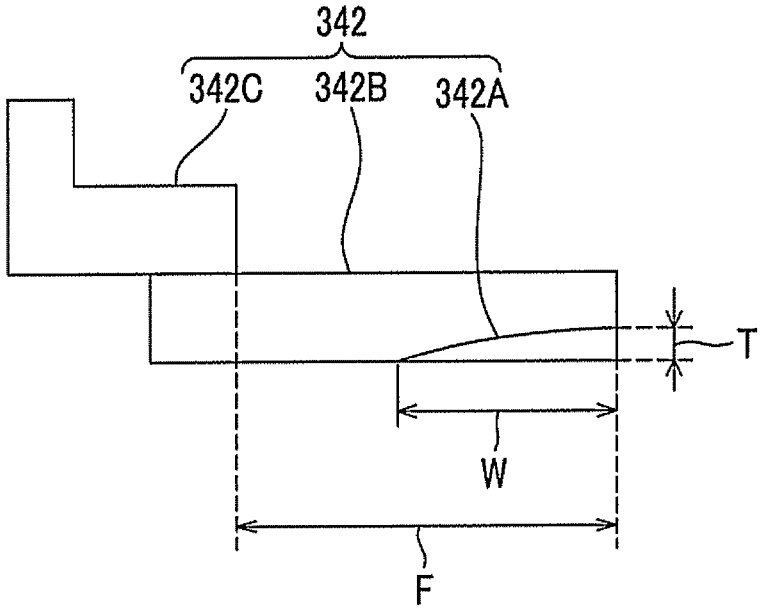
FIG. 2 is a side view of the cleaning blade shown in FIG. 1.
Figure 3:
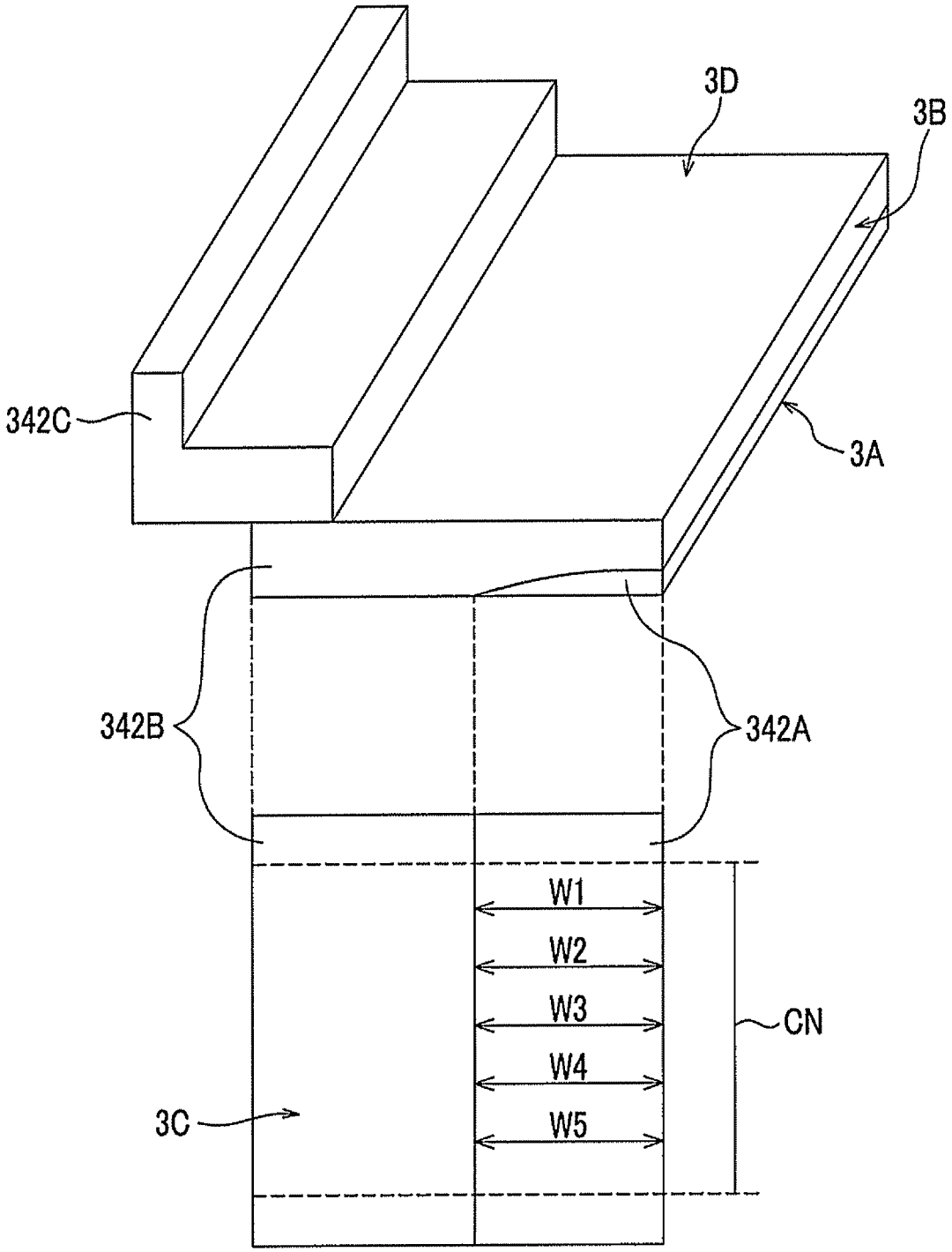
FIG. 3 is a perspective view and a plan view from a ventral side of a cleaning blade shown in FIG. 1.

Herein, FIG. 2 shows a side view of the cleaning blade 342 shown in FIG. 1, and FIG. 3 shows a perspective view of the cleaning blade 342 and plan view of the contacting layer 342A and the rear surface layer 342B (that is, the portion other than the supporting member 342C of the cleaning blade 342) from the rear surface 3C side.

Ratio (T/W)

As shown in FIG. 2, the longitudinal direction maximum length of the contacting layer 342A is set as (T), and the longitudinal direction maximum length thereof is set as (W). In addition, as shown in the perspective view of FIG. 3, in the contacting layer 342A of the cleaning blade 342, the longitudinal direction maximum length (T) is substantially equivalent in any region in the short direction. In addition, as shown with (W1) to (W5) in the plan view on the ventral surface 3C side of FIG. 3, the longitudinal direction maximum length (W) is equivalent in any region in the short direction. In the contacting layer 342A of the cleaning blade 342, the ratio (T/W) of the longitudinal direction maximum length (T) and the longitudinal direction maximum length (W) is equal to or less than 0.35.

In the related art, when the contacting corner portion of the cleaning blade comes in contact with a driving member to be cleaned such as the photoreceptor drum 31, the contacting corner portion repeats in a small motion to follow the driving of the member to be cleaned and move in the surface moving direction, and then, to be released from the following to return to the original position, that is, vibration generates and amplitude of the vibration, that is, a distance of movement of the cleaning blade by the following becomes greater. In the cleaning blade, as the vibration becomes greater, a scrape of a foreign material to be removed (for example, toner or the like in a case of coming in contact with the photoreceptor drum 31 shown in FIG. 1) is generated, and a cleaning property is degraded.

With respect to this, as shown in FIGS. 1 to 3, by setting the ratio (T/W) on the contacting layer 342A of the cleaning blade 342 to be equal to or less than 0.35, the magnitude of the vibration (magnitude of the amplitude) is efficiently decreased, and an excellent cleaning property is exhibited.

Herein, "CN" shown in FIG. 3 shows a region contributing for cleaning (hereinafter, referred to as a "cleaning contribution region). As shown in FIG. 1, since the cleaning blade 342 comes in contact with the photoreceptor drum 31 in an electrophotographic image forming apparatus as a member to be cleaned, the cleaning contribution region CN of FIG. 3 indicates a region which comes in contact with an image forming region where an image forming material such as the toner or the like is developed. In addition, in a case where the cleaning blade according to the exemplary embodiment is used for cleaning of a surface of a member to be cleaned other than the photoreceptor drum, the cleaning contribution region CN indicates a region corresponding to a region of the member to be cleaned where a foreign material to be removed is attached.

In addition, in the cleaning blade 342 shown in FIG. 3, a region where the ratio (T/W) satisfies a relationship equal to or less than 0.35 occupies 100%, in the short direction of the cleaning contribution region CN.

However, a region where the ratio (T/W) satisfies a relationship equal to or less than 0.35 may be equal to or more than 95% in the cleaning contribution region CN in the short direction of the cleaning blade.

Figure 4:
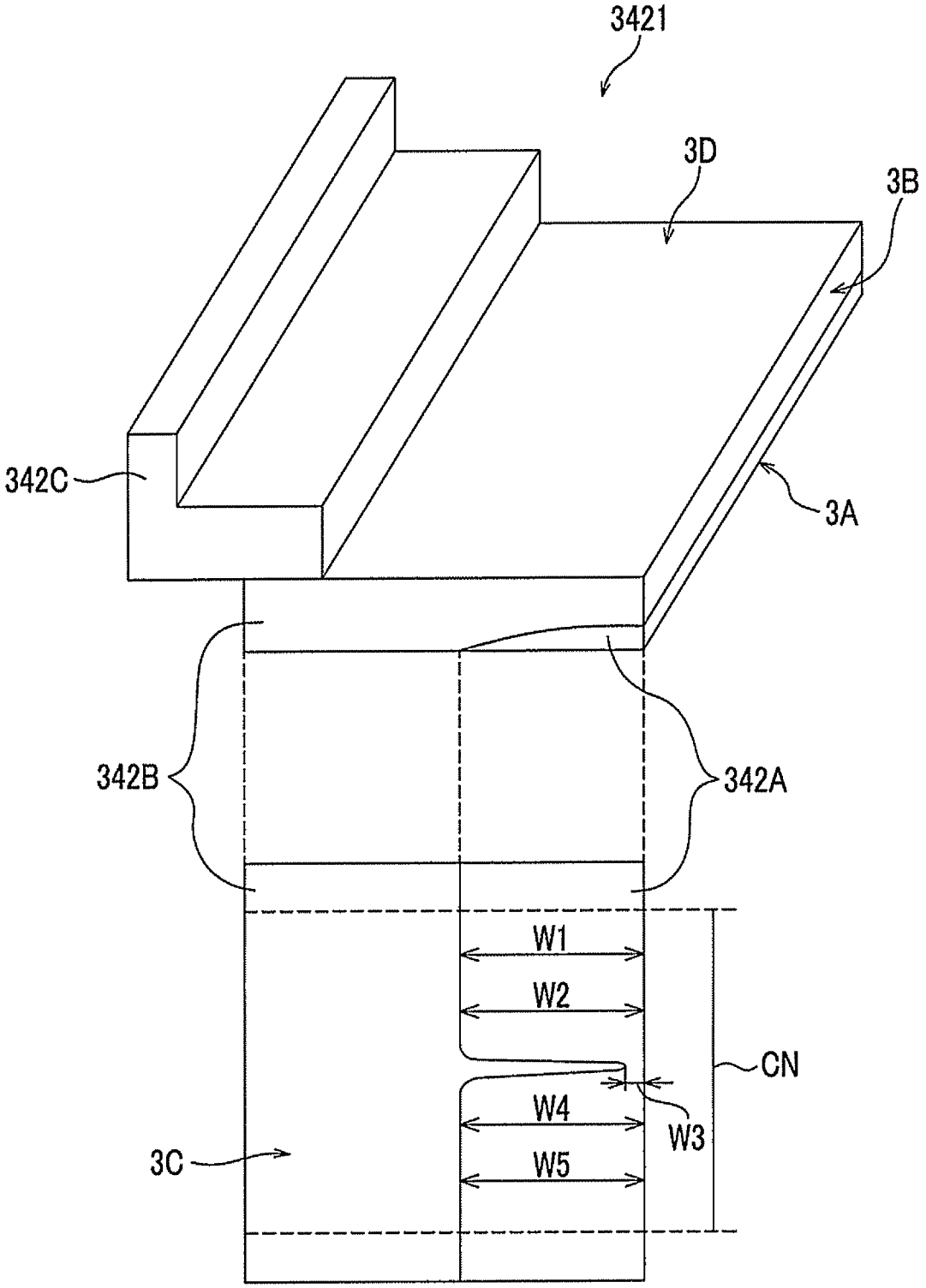
FIG. 4 is a perspective view and a plan view from a ventral side showing another exemplary embodiment of a cleaning blade according to the exemplary embodiment.

For example, as shown in a cleaning blade 3421 shown in a perspective view and a plan view on the ventral surface 3C side in FIG. 4, the ratio (T/W) may not satisfy a relationship equal to or less than 0.35 in a part of the region. In the cleaning blade 3421 shown in FIG. 4, the longitudinal direction maximum length (T) of the contacting layer 342A is equivalent in any region in the short direction, however, on the other side, the longitudinal direction maximum length (W) has a shorter portion of (W3) with respect to portions of (W1, W2, W4, and W5). The ratio (T/W) satisfies a relationship equal to or less than 0.35 in regions of (W1, W2, W4, and W5), however, the ratio (T/W) is less than 0.35 in a region of (W3). However, in the cleaning blade 3421, a region including the portion of (W3), where the ratio (T/W) is less than 0.35, is set to be equal to or less than 5% in the cleaning contribution region CN in the short direction.

If a region where the ratio (T/W) satisfies a relationship equal to or less than 0.35 is equal to or more than 95% in the cleaning contribution region CN in the short direction, the magnitude of the vibration (magnitude of the amplitude) in the entire cleaning blade is efficiently decreased, and an excellent cleaning property is exhibited.

In addition, as shown in FIG. 4, since the region where the longitudinal direction maximum length (W) is partially shortened is included, the region where the ratio (T/W) does not satisfy a relationship equal to or less than 0.35 is in a range of equal to or less than 5% in the cleaning contribution region CN in the short direction. And thus, even when the generated vibration is attempted to be transmit to the contacting layer 342A in the short direction, the transmission is shielded by the region with the shortened longitudinal direction maximum length (W), and an effect of suppressing the transmission of the vibration is obtained.

In addition, as long as the region where the ratio (T/W) satisfies a relationship equal to or less than 0.35, satisfies conditions of equal to or more than 95% of the cleaning contribution region CN, in a case other than the case shown in FIG. 4, a part of a region having a portion of longer thickness maximum length (T) with respect to the other portions may be obtained, and in that part of the region, the ratio (T/W) may not satisfy a relationship equal to or more than 0.35.

In the contacting layer 342A, determination whether or not the region where the ratio (T/W) satisfies a relationship equal to or less than 0.35 is equal to or more than 95% of the cleaning contribution region CN, is performed by measuring the longitudinal direction maximum length (T) and the longitudinal direction maximum length (W), measuring a short direction length of a region where the ratio (T/W) is less than 0.35, and calculating a rate of the length with respect to the short direction length of the cleaning contribution region CN.

In the exemplary embodiment, a region where the ratio (T/W) satisfies a relationship equal to or less than 0.35 is desirable to be equal to or more than 95% in a region contribution for cleaning in the short direction, and further is desirable to be closer to 100%.

In addition, a value of the ratio (T/W) is more desirable to be equal to or less than 0.25, and further more desirable to be equal to or less than 0.2. In addition, the lower limit value is not particularly limited, however, is desirable to be equal to or more than 0.01, and more desirable to be equal to or more than 0.05.

In addition, although not particularly limited, a range of the longitudinal direction maximum length (T) is desirable to be from 0.1 mm to 1.0 mm, more desirable to be from 0.2 mm to 0.8 mm, and further desirable to be from 0.3 mm to 0.6 mm. In addition, a range of the longitudinal direction maximum length (W) is desirable to be from 0.5 mm to 7.0 mm, more desirable to be from 1.0 mm to 6.0 mm, further desirable to be 2.0 mm to 5.0 mm.

Blade Free Length

As shown in FIG. 2, the supporting member (holder) 342C is disposed so that a length from the end portion of the rear surface 3D in the tip surface 3B side to the end portion of the supporting member 342C on the tip surface 3B side in a state of being adhered to the rear surface 3D, that is, a longitudinal direction length (so-called blade free length (F)) of a region of the rear surface 3D not supported by the supporting member 342C, is longer than the maximum length of the contacting layer (edge member) 342A in the longitudinal direction. In addition, an adhesive is normally applied to the entire surface of the adhered surface of the supporting member 342C and the rear surface 3D, to adhere the supporting member and the rear surface. However, the supporting member and the rear surface may be adhered to each other in a state where the adhesive is applied further toward the tip surface 3B side with respect to the end portion of the supporting member 342C on the tip surface 3B side, and reversely, the supporting member and the rear surface may be adhered to each other in a state where the adhesive is not applied to the end portion of the supporting member 342C on the tip surface 3B side, that is, in a state where a region not adhered to the supporting member 342C end side is obtained. However, in any cases, the blade free length (F) is based on the end portion of the supporting member 342C on the tip surface 3B side, not the end portion of the region to which the adhesive is applied.

As hardness of the contacting layer (edge member) 342A becomes high, permanent deformation (settling) tends to be significantly generated, and particularly, if dynamic ultra microhardness is high as equal to or more than 0.25, permanent deformation (settling) is generated, in some cases.

With respect to this, by adjusting so that the blade free length (F) is longer than the maximum length of the contacting layer 342A in the longitudinal direction, that is, by adjusting so that a region supported by the supporting member 342C and a region where the contacting layer 342A is formed are not overlapped to each other in the longitudinal direction, generation of permanent deformation (settling) is efficiently suppressed.

Shape of Contacting Layer

In addition, in the cleaning blade 342 of FIGS. 1 to 3, as the shape of the contacting layer (edge member) 342A from the side view side, a shape where a boundary of the contacting layer 342A and the rear surface layer (rear surface member) 342B gradually approaches from the tip surface 3B to the ventral surface 3C side in the longitudinal direction in arc shape is shown, however, other shapes may be used. For example, as a cleaning blade 3422 shown in FIG. 5, the shape of the contacting layer (edge member) 342A from the side view side may be in a rectangular shape, and is not particularly limited.

Figure 5:
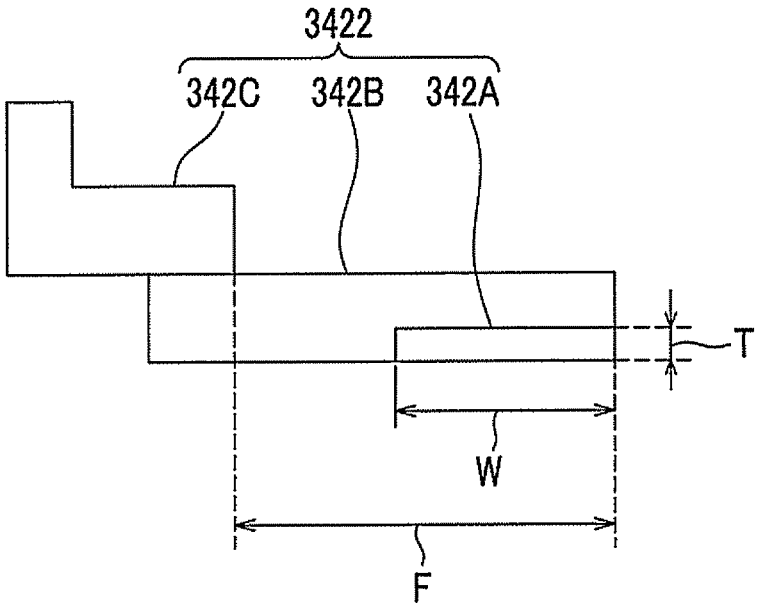
FIG. 5 is a side view showing another exemplary embodiment of a cleaning blade according to the exemplary embodiment.
Figure 6:
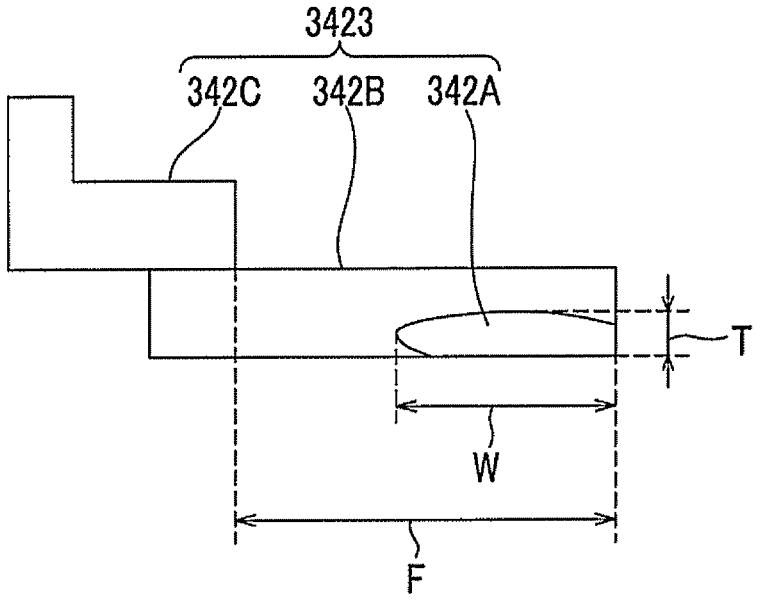
FIG. 6 is a side view showing another exemplary embodiment of a cleaning blade according to the exemplary embodiment.

Further, in the cleaning blade 342 of FIGS. 1 to 3, and the cleaning blade 3422 shown in FIG. 5, the embodiment in which the longitudinal direction maximum length (T) of the contacting layer 342A is a length on the surface of the tip surface 3B, and the longitudinal direction maximum length (W) is a length on the surface of the ventral surface 3C is shown, however, other shapes may be used. For example, as a cleaning blade 3423 shown in FIG. 6, a shape where the length of the contacting layer 342A in the longitudinal direction is maximum (a portion having the longitudinal direction maximum length (T)) may be on the inner side with respect to the tip surface 3B, and a shape where the length thereof in the longitudinal direction (a portion having the longitudinal direction maximum length (W)) may be on the inner side with respect to the ventral surface 3C may be, however, they are not particularly limited.

Next, a composition of the contacting layer (edge member) of the cleaning blade of the exemplary embodiment will be described.

Composition of Contacting Layer

The contacting layer (edge member) of the cleaning blade according to the exemplary embodiment is configured with a material having dynamic ultra microhardness of 0.25 to 0.65, and as long as the conditions are satisfied, the material thereof is not particularly limited, and any well-known materials may be used. By setting the dynamic ultra microhardness of the contacting layer to be high to be equal to or more than 0.25, magnitude of vibration (magnitude of amplitude) to be generated on the cleaning blade is efficiently decreased, and an excellent cleaning property is exhibited.

Dynamic Ultra Microhardness

The dynamic ultra microhardness is hardness calculated with a test load P (mN) and a pressing depth D (μm) when indenting an indenter into a specimen at a constant pressing speed (mN/s) as shown in the following equation.

$$DH=\alpha\times P/D^2 \qquad \text{Equation:}$$

In the equation, α represents a constant due to an indenter shape.

In addition, measurement of the dynamic ultra microhardness is performed with Dynamic Ultra Microhardness tester DUH-W201S (manufactured by Shimadzu Corporation).

The dynamic ultra microhardness is acquired by measuring the pressing depth D when indenting a diamond triangular pyramid indenter (interridge angle: 115°, α: 3.8584) at the pressing speed of 0.047399 mN/s, with a test load of 4.0 mN, and in an environment at 23° C. by soft material measurement.

In addition, in general, the portion of the cleaning blade which comes in contact with the member to be cleaned is a normal corner portion. Accordingly, from a viewpoint of performing measurement in a location to indent the triangular pyramid indenter, in a state where the corner portion (contacting corner portion 3A in FIG. 1) configures one side and the corner portion comes in contact with the driving member to be cleaned, the actual measurement portion is set to a location which is deviated by 0.5 mm from the corner portion with respect to a surface (ventral surface 3C in FIG. 1) side facing the downstream side of the surface moving direction. In addition, the measurement is performed for five arbitrary portions of the measurement portion, and the average value thereof is set to the dynamic ultra microhardness.

The physical property value of the dynamic ultra microhardness of the contacting layer is controlled by the following unit, for example.

For example, if the material of the contacting layer of the cleaning blade is polyurethane, the dynamic ultra microhardness tends to become high by improving crystallinity of the polyurethane. In addition, the dynamic ultra microhardness tends to become high due to increase of chemical crosslink (increase of crosslink points), and also tends to become high due to increase of the amount of hard segments.

However, the adjustment of the dynamic ultra microhardness is not limited to the method described above.

The numerical value of the dynamic ultra hardness of the contacting layer is from 0.25 to 0.65. If the dynamic ultra microhardness is less than the lower limit value, hardness of the contacting layer is insufficient and magnitude of the vibration is not suppressed and, as a result, an excellent cleaning property is not obtained. Meanwhile, if the dynamic ultra microhardness exceeds the upper limit value, since the cleaning blade does not follow the driving member to be cleaned because the contacting layer is too hardened, an excellent cleaning property is not obtained.

In addition, the dynamic ultra hardness is more desirable to be from 0.28 to 0.63 and further desirable to be from 0.3 to 0.6.

Impact Resilience

In addition, in the contacting layer (edge member) of the exemplary embodiment, from a viewpoint of suppression of the edge cracks, 10° C. impact resilience is desirable to be equal to or more than 10%, more desirable to be equal to or more than 15%, and further desirable to be equal to or more than 20%. In addition, from a viewpoint of suppression of blade noise, the upper limit value thereof is desirable to be equal to or less than 80%, more desirable to be equal to or less than 70%, and further desirable to be equal to or less than 60%.

The measurement of the 10° C. impact resilience (%) is performed under an environment at 10° C. based on JIS K 6255 (1996). In addition, in a case where the size of the contacting layer of the cleaning blade is equal to or larger than the dimension of a standard test piece of JIS K 6255, the measurement described above is performed by cutting the part to be equal to the dimension of the test piece from the member. Meanwhile, in a case where the size of the contacting layer is smaller than the dimension of the test piece, the test piece is formed with the same material as the member, and the measurement is performed for the test piece.

A physical value of the 10° C. impact resilience of the contacting layer is controlled by the following unit, for example.

For example, the 10° C. impact resilience tends to become larger as crosslink density is improved due to trifunctional crosslink or weight increase thereof. In addition, if the material of the contacting layer is polyurethane, the 10° C. impact resilience tends to become larger by reducing a glass transition temperature (Tg) due to low molecular weight of polyol or introduction of hydrophobic polyol.

However, the adjustment of the 10° C. impact resilience is not limited to the method described above.

As the material of the contacting layer (edge member) of the exemplary embodiment, a material which satisfies the conditions of the dynamic ultra microhardness described above is used, and for example, polyurethane rubber, silicon rubber, fluoro-rubber, chloroprene rubber, butadiene rubber, or the like is used. Among them, from a viewpoint of satisfying conditions thereof, polyurethane rubber is desirable and particularly highly crystallized polyurethane rubber is more desirable.

As a method of improving crystallinity of the polyurethane, a method of further growing hard segment aggregates of the polyurethane is used, for example. In detail, an environment in which the hard segment aggregates are easy to further grow, is prepared by adjusting so that physical crosslink (crosslink due to hydrogen bond between hard segments) progresses more efficiently than chemical crosslink (crosslink due to a cross-linking agent) when forming a crosslink structure of polyurethane. In addition, as a polymerization temperature is set to be lower at the time of polymerizing polyurethane, the aging time becomes longer, and as a result, the physical crosslink tends to progress further.

Endothermic Peak Top Temperature

An endothermic peak top temperature (melting temperature) is used for an index of crystallinity. In the cleaning blade according to the exemplary embodiment, an endothermic peak top temperature (melting temperature) due to differential scanning calorimetry (DSC) is desirable to be equal to or higher than 180° C., more desirable to be equal to or higher than 185° C., and further desirable to be equal to or higher than 190° C. In addition, the upper limit value thereof is desirable to be equal to or lower than 220° C., more desirable to be equal to or lower than 215° C., and further to be equal to or lower than 210° C.

In addition, the endothermic peak top temperature (melting temperature) is measured based on ASTMD3418-99 of differential scanning calorimetry (DSC). PerkinElmer's Diamond-DSC is used for the calorimetry, a melting temperature of indium and zinc is used for temperature correction of a device detection unit, and heat of fusion of indium is used for correction of calorie. An aluminum pan is used for a calorimetry sample, and an empty pan is set for comparison and the calorimetry is performed.

Particle Size and Particle Size Distribution of Hard Segment Aggregate

In addition, in the exemplary embodiment, it is desirable that the polyurethane rubber include hard segments and soft segments, and an average particle size of aggregates of the hard segments be from 5 μm to 20 μm.

By setting the average particle size of the aggregates of the hard segments to be equal to or more than 5 μm, it is advantageous to increase a crystalline area in the blade surface and to improve a sliding property. Meanwhile, by setting the average particle size of the aggregates of the hard segments to be equal to or less than 20 μm, it is advantageous to maintain a low-friction property and not to lose toughness (crack resistance).

The average particle size is more desirable to be from 5 μm to 15 μm, and further desirable to be from 5 μm to 10 μm.

In addition, it is desirable that the particle size distribution (standard deviation σ) of the aggregates of the hard segments be equal to or more than 2.

The particle size distribution (standard deviation σ) of the aggregates of the hard segments being equal to or more than 2 shows that various particle sizes are mixed, and an effect of high hardness due to the increase of the contacting area with the soft segments, is obtained with small aggregates, and meanwhile, an effect of the improvement of the sliding property is obtained with large aggregates.

The particle size distribution is more desirable to be from 2 to 5, and further desirable to be from 2 to 3.

In addition, the average particle size and the particle size distribution of the hard segment aggregates are measured with the following method. An image is captured with a magnification of ×20 by using a polarization microscope (BX51-P manufactured by Olympus), the image is binarized by being subjected to an imaging process, the particle size thereof is measured with 20 cleaning blades by measuring five points for one cleaning blade (measuring five aggregates for one point), and the average particle size from 500 particle sizes is calculated.

In addition, with the image binarization, threshold values of hue, chroma, and illuminance are adjusted so as to display black for crystal portion and white for non-crystal portion by using image processing software of OLYMPUS Stream essentials (manufactured by Olympus).

In addition, the particle size distribution (standard deviation σ) is calculated from the measured 500 particle sizes with the following equation.

$$\text{Standard deviation } \sigma=\sqrt{\{(X1-M)^2+(X2-M)^2+\ldots+(X500-M)^2\}/500}$$

Xn: Measured particle size n (n=from 1 to 500)

M: Average value of the measured particle size

The particle size and the particle size distribution (standard deviation σ) of the hard segment aggregates are controlled in the range described above. It is not particularly limited to a unit thereof, and for example, methods of reaction control with a catalyst, three-dimensional network control with a cross-linking agent, crystal growth control with aging conditions, and the like are used.

The polyurethane rubber is synthesized by polymerizing typical polyisocyanate and polyol. In addition, other than polyol, a resin including a functional group which may react with an isocyanate group may be used. In addition, it is desirable that the polyurethane rubber include hard segments and soft segments.

Herein, the "hard segments" and the "soft segments" mean segments which are configured of a material in which a material configuring the former is relatively harder than a material configuring the latter, and a material in which a material configuring the latter is relatively softer than a material configuring the former, in the polyurethane rubber materials.

It is not particularly limited, however, as a combination of the material (hard segment material) configuring the hard segments and the material (soft segment material) configuring the soft segments, well-known resin materials may be selected so as to have a combination in which one is relatively harder than the other, and the other one is relatively softer than the first. In this exemplary embodiment, the following combination is suitable.

Soft Segment Material

First, polyol as the soft segment material, polyester polyol obtained by a dehydration synthesis of diol and dibasic acid, polycarbonate polyol obtained with a reaction of diol and alkyl carbonate, polycaprolactone polyol, polyether polyol, or the like is used. In addition, as a commercialized product of the polyol used as the soft segment material, PLACCEL 205 or PLACCEL 240 manufactured by Daicel Corporation is used.

Hard Segment Material

In addition, as the hard segment material, it is desirable to use a resin including a functional group which may react with respect to an isocyanate group. Further, a flexible resin is desirable, and a resin with aliphatic system including a straight-chain structure is more desirable from a viewpoint of flexibility. As a detailed example, it is desirable to use an acrylic resin including two or more hydroxyl groups, a polybutadiene resin including two or more hydroxyl groups, an epoxy resin including two or more epoxy groups, or the like.

As a commercialized product of the acrylic resin including two or more hydroxyl groups, for example, ACTFLOW (Grade: UMB-2005B, UMB-2005P, UMB-2005, UME-2005 or the like) manufactured by Soken Chemical & Engineering Co., Ltd is used.

As a commercialized product of the polybutadiene resin including two or more hydroxyl groups, for example, R-45HT or the like manufactured by Idemitsu Kosan Co., Ltd. is used.

As the epoxy resin including two or more epoxy groups, a resin having a hard and fragile property as a general epoxy resin of the related art is not desirable, but a resin having a softer and stronger property than the epoxy resin of the related art is desirable. As the epoxy resin, for example, in a property of a molecular structure, in a main chain structure thereof, a resin including a structure (flexible skeleton) which may increase the mobility of the main chain is suitable, and as the flexible skeleton, an alkylene skeleton, cycloalkane skeleton, a polyoxyalkylene skeleton or the like is used, and particularly a polyoxyalkylene skeleton is suitable.

In addition, in a physical property, an epoxy resin in which viscosity is low compared with molecular weight is suitable compared with the epoxy resin of the related art. In detail, weight-average molecular weight is in a range of 900±100, viscosity in 25° C. is desirably in a range of 15000±5000 mPa·s and more desirably in a range of 15000±3000 mPa·s. As a commercialized product of the epoxy resin including the properties described above, EPLICON EXA-4850-150 or the like manufactured by DIC Corporation is used.

In a case of using the hard segment material and the soft segment material, a weight ratio (hereinafter, referred to as "hard segment material ratio") of the material configuring the hard segment with respect to the total of the hard segment material and the soft segment material is desirably in a range from 10% by weight to 30% by weight, more desirably in a range from 13% by weight to 23% by weight, and even more desirably in a range from 15% by weight to 20% by weight.

Since the hard segment material ratio is equal to or more than 10% by weight, the abrasion resistance property is obtained and an excellent cleaning property is maintained over a long period. Meanwhile, since the hard segment material ratio is equal to or less than 30% by weight, the flexibility and expendability is obtained while preventing becoming too hard, the generation of the cracks is suppressed, and an excellent cleaning property is maintained over a long period.

Polyisocyanate

As polyisocyanate used for the synthesis of the polyurethane rubber, for example, 4,4'-diphenyl methane diisocyanate (MDI), 2,6-toluene diisocyanate (TDI), 1,6-hexane diisocyanate (HDI), 1,5-naphthalene diisocyanate (NDI), and 3,3-dimethylphenyl-4,4-diisocyanate (TODI) are used.

In addition, in a viewpoint of easy formation of the hard segment aggregate with the desired size (particle size), as polyisocyanate, 4,4'-diphenyl methane diisocyanate (MDI), 1,5-naphthalene diisocyanate (NDI), and hexamethylene diisocyanate (HDI) are more desirable.

A blending quantity of polyisocyanate with respect to resins with 100 parts by weight including a functional group which may react with respect to the isocyanate group of polyisocyanate is desirable to be from 20 parts by weight to 40 parts by weight, more desirable to be from 20 parts by weight to 35 parts by weight, and further desirable to be from 20 parts by weight to 30 parts by weight.

Since the blending quantity is equal to or more than 20 parts by weight, a large bonding amount of urethane is secured to obtain the hard segment growth, and a desired hardness is obtained. Meanwhile, since the blending quantity is equal to or less than 40 parts by weight, the hard segment does not become too large, the expandability is obtained, and the generation of the crack on the cleaning blade is suppressed.

Cross-Linking Agent

As a cross-linking agent, diol (bifunction), triol (trifunction), tetraol (tetrafunction), or the like is used, and these may be used together. In addition, as a cross-linking agent, an amine based compound may be used. Further, a cross-linking agent with trifunction or more is desirable to be used for cross-linking. As the trifunctional cross-linking agent, for example, trimethylolpropane, glycerin, tri-isopropanolamine and the like are used.

A blending quantity of the cross-linking agent with respect to resins with 100 parts by weight including a functional group which may react with respect to the isocyanate group is desirably equal to or less than 2 parts by weight. Since the blending quantity is equal to or less than 2 parts by weight, molecular motion is not restrained due to chemical crosslink, hard segment derived from urethane bonding due to aging is largely grown, and the desired hardness is easily obtained.

Method of Manufacturing Polyurethane Rubber

For manufacture of the polyurethane rubber member configuring the contacting layer of the exemplary embodiment, a general method of manufacturing the polyurethane such as a prepolymer method or a one-shot method is used. Since polyurethane with excellent intensity and abrasion resistance property is obtained, the prepolymer method is suitable for the exemplary embodiment, however the method of manufacturing is not limited.

In addition, as a unit that controls the endothermic peak top temperature (melting temperature) of the contacting layer within the range described above, a method of improving crystalline property of the polyurethane member and controlling the endothermic peak top temperature within a proper limit is used, and for example, a method of further growing the hard segment aggregate of the polyurethane is used. In detail, a method of adjusting so that physical crosslink (crosslink with hydrogen bond between hard segments) proceeds efficiently compared to the chemical crosslink (crosslink with the cross-linking agent) in a case of the formation of the cross-linked structure of the polyurethane is used, and in a case of polymerization of the polyurethane, as a polymerization temperature is set to be low, the aging time becomes long, and as a result, the physical crosslink tends to proceed more.

Such polyurethane rubber member is molded by blending the isocyanate compound and the cross-linking agent or the like to the polyol described above under molding conditions to suppress unevenness of molecular arrangement.

In detail, in a case of adjusting a polyurethane composition, the polyurethane composition is adjusted by setting a temperature of polyol or prepolymer low or setting a temperature of curing and molding low so that the crosslink proceeds slowly. Since the urethane bonding portion is aggregated and a crystalline member of the hard segment is obtained by setting the temperatures (temperature of polyol or prepolymer and temperature of curing and molding) low to lower a reactive property, the temperatures are adjusted so that the particle size of the hard segment aggregate becomes the desired crystal size.

Accordingly, a state in which the molecule included in the polyurethane composition is arranged is set, and in a case of measuring the DSC, the polyurethane rubber member including the crystalline member in which the endothermic peak top temperature of crystal melting energy is in the range described above is molded.

In addition, the amounts of the polyol, the polyisocyanate, and the cross-linking agents, ratio of cross-linking agents, and the like are adjusted within a desired range.

Herein, as an example, a method of manufacturing polyurethane used for the contacting layer (edge member) will be described in detail.

First, the soft segment material (for example, polycaprolactone polyol) and the hard segment material (for example, acrylic resin including two or more hydroxyl groups) are mixed (for example, a weight ratio of 8:2).

Next, the isocyanate compound (for example, 4,4'-diphenyl methane diisocyanate) is added with respect to the mixture of the soft segment material and the hard segment material, and reacts under a nitrogen atmosphere for example. At that time, the temperature is desirable to be from 60° C. to 150° C. and more desirable to be from 80° C. to 130° C. In addition, the reaction time is desirable to be from 0.1 hour to 3 hours, and more desirable to be from 1 hour to 2 hours.

Next, the isocyanate compound is further added to the mixture, and the mixture is reacted under a nitrogen atmosphere for example, to obtain a prepolymer. At that time, the temperature is desirable to be from 40° C. to 100° C. and more desirable to be from 60° C. to 90° C. In addition, the reaction time is desirable to be from 30 minutes to 6 hours, and more desirable to be from 1 hour to 4 hours.

Next, the temperature of the prepolymer is increased and subjected to defoaming under the reduced pressure. At that time, the temperature is desirable to be from 60° C. to 120° C. and more desirable to be from 80° C. to 100° C. In addition, the reaction time is desirable to be from 10 minutes to 2 hours, and more desirable to be from 30 minutes to 1 hour.

After that, a cross-linking agent (for example, 1,4-butanediol or trimethylolpropane) is added and mixed with respect to the prepolymer, and a composition for the cleaning blade formation is prepared.

Next, the composition for the cleaning blade formation is poured into a mold of a centrifugal molding machine, and subjected to the curing reaction. At that time, the mold temperature is desirable to be from 80° C. to 160° C., and more desirable to be from 100° C. to 140° C. In addition, the reaction time is desirable to be from 20 minutes to 3 hours, and more desirable to be from 30 minutes to 2 hours. Further, the mold is subjected to cross-linking reaction, cooled, and then cut, and accordingly, the cleaning blade is formed. The temperature of aging heating in a case of cross-linking reaction is desirable to be from 70° C. to 130° C., and more desirable to be from 80° C. to 130° C., and further more desirable to be from 100° C. to 120° C. In addition, the reaction time is desirable to be from 1 hour to 48 hours, and more desirable to be from 10 hours to 24 hours.

Physical Property

In the specified member, a ratio of the physical crosslink (cross-link with hydrogen bonding between hard segments) to the chemical crosslink (crosslink with cross-linking agent) "1" in the polyurethane rubber is desirably 1:0.8 to 1:2.0, and more desirably 1:1 to 1:1.8.

Since the ratio of the physical crosslink to the chemical crosslink is equal to or more than the lower limit, the hard segment aggregate further grows and an effect of the low friction property derived from the crystal is obtained. Meanwhile, since the ratio of the physical crosslink to the chemical crosslink is equal to or less than the upper limit, an effect of maintaining the toughness is obtained.

In addition, the ratio of the chemical crosslink and the physical crosslink is calculated using the following Mooney-Rivlin equation.

$$\sigma=2C_1(\lambda-1/\lambda^2)+2C_2(1-1/\lambda^3)$$

$\sigma$: stress, $\lambda$: strain, $C_1$: chemical crosslink concentration, $C_2$: physical crosslink In addition, $\sigma$ and $\lambda$ at the time of extension of 10% are used with a stress-strain line by a tension test.

In the specified member, a ratio of the hard segment to the soft segment "1" in the polyurethane rubber is desirable to be 1:0.15 to 1:0.3, and more desirable to be 1:0.2 to 1:0.25.

Since the ratio of the hard segment to the soft segment is equal to or more than the lower limit, an amount of hard segment aggregates increases and thus an effect of the low-friction property is obtained. Meanwhile, Since the ratio of the hard segment to the soft segment is equal to or less than the upper limit, an effect of maintaining the toughness is obtained.

In addition, with the ratio of the soft segment and the hard segment, a composition ratio is calculated from a spectrum area of isocyanate as the hard segment component, a chain extender, and polyol as the soft segment component, using $^1$H-NMR.

The weight-average molecular weight of the polyurethane rubber member of the exemplary embodiment is desirably in a range of 1000 to 4000, and more desirably in a range of 1500 to 3500.

Rear Surface Layer

The rear surface layer (rear surface member) of the cleaning blade according to the exemplary embodiment is not particularly limited, and any known materials may be used.

Impact Resilience

In addition, as the rear surface layer (rear surface member), among them, it is desirable to be configured of a material having impact resilience at 50° C. of equal to or less than 70%, more desirable to be configured of a material having impact resilience at 50° C. of equal to or less than 65%, and further desirable to be configured of a material having impact resilience at 50° C. of equal to or less than 60%. In addition, the lower limit value thereof is desirable to be equal to or more than 20%, more desirable to be equal to or more than 25%, and further desirable to be equal to or more than 30%.

When cleaning by bringing the cleaning blade in contact with the member to be cleaned such as an electrophotographic photoreceptor, an adhesive force is generated between the member to be cleaned and the cleaning blade due to a usage environment, frictional resistance on a contacting surface of tips of the member to be cleaned and the cleaning blade becomes large, amplitude of the cleaning blade becomes larger with the driving of the member to be cleaned, and thus, abnormal noise which is so-called "blade noise" may occur.

However, by providing the rear surface layer with the impact resilience in the range described above, the generation of the abnormal noise is efficiently suppressed.

The measurement of the impact resilience (%) at 50° C. is performed under an environment at 50° C. based on JIS K 6255 (1996). In addition, in a case where the size of the rear surface layer of the cleaning blade is equal to or larger than the dimension of a standard test piece of JIS K 6255, the measurement described above is performed by cutting the part to be equal to the dimension of the test piece from the member. Meanwhile, in a case where the size of the rear surface layer is smaller than the dimension of the test piece, a test piece is formed with the same material as the member, and the measurement is performed for the test piece.

For example, if the material of the rear surface layer is polyurethane, the physical property value of 50° C. impact resilience of the rear surface layer tends to become large by adjusting the glass transition temperature (Tg) due to low molecular weight of polyol or a method of introducing hydrophobic polyol.

However, the adjustment of the 50° C. impact resilience is not limited to the method described above.

Hardness

In addition, as the rear surface layer (rear surface member), it is desirable to be configured of a material having a numerical value of the dynamic ultra microhardness of 0.04 to 0.1, more desirable to be configured of a material having a numerical value of the dynamic ultra microhardness of 0.05 to 0.09, and further desirable to be configured of a material having a numerical value of the dynamic ultra microhardness of 0.06 to 0.08.

The dynamic ultra microhardness is hardness calculated with a test load P (mN) and a pressing depth D (μm) when indenting an indenter into a specimen at a constant pressing speed (mN/s) as shown in the following equation.

$$DH=\alpha\times P/D^2 \qquad \text{Equation:}$$

In the equation, $\alpha$ shows a constant due to an indenter shape.

In addition, the measurement of the dynamic ultra microhardness is performed with Dynamic Ultra Microhardness tester DUH-W201S (manufactured by Shimadzu Corporation). The dynamic ultra microhardness is acquired by measuring the pressing depth D when indenting a diamond triangular pyramid indenter (interridge angle: 115°, $\alpha$: 3.8584) at the pressing speed of 0.047399 mN/s, with a test load of 4.0 mN, and in an environment at 23° C. by soft material measurement.

In addition, from a viewpoint of performing measurement in a location to indent the triangular pyramid indenter, in a state where the corner portion (contacting corner portion 3A in FIG. 1) configures one side and the corner portion comes in contact with the driving member to be cleaned, the measurement portion of the rear surface layer for the dynamic ultra microhardness is set to a location with no contacting layer with respect to a surface (ventral surface 3C in FIG. 1) side facing the downstream side of the surface moving direction. In addition, the measurement is performed for five arbitrary portions of the measurement portion, and the average value thereof is set to the dynamic ultra microhardness.

The physical property value of the dynamic ultra microhardness of the rear surface layer tends to become high due to increase of chemical crosslink (increase of crosslink points).

However, the adjustment of the dynamic ultra microhardness is not limited to the method described above.

Permanent Elongation

In addition, it is desirable that the rear surface layer (rear surface member) of the cleaning blade according to the exemplary embodiment be configured with a material having 100% permanent elongation of equal to or less than 1.0%. The 100% permanent elongation thereof is more desirable to be equal to or less than 0.9%, and further desirable to be equal to or less than 0.8%.

By providing a rear surface layer with 100% permanent elongation in the range described above, generation of settling (permanent deformation) is suppressed, contact pressure of the cleaning blade is maintained, and as a result, an excellent cleaning property is maintained.

Herein, a method of measuring the 100% permanent elongation (%) will be described. A strip test piece is used according to JIS K 6262 (1997) and 100% tensile strain is applied and is left for 24 hours, and the measurement is performed with gauge lengths as the following equation.

$$Ts=(L2-L0)/(L1-L0)\times 100$$

Ts: permanent elongation

L0: gauge length before tensile

L1: gauge length at the time of tensile

L2: gauge length after tensile

In addition, in a case where the size of the rear surface layer of the cleaning blade is equal to or larger than the dimension of the standard strip test piece of JIS K 6262, the measurement described above is performed by cutting the part to be equal to the dimension of the strip test piece from the member. Meanwhile, in a case where the size of the rear surface layer is smaller than the dimension of the strip test piece, a strip test piece is formed with the same material as the member, and the measurement described above is performed for the strip test piece.

The physical property value of the 100% permanent elongation of the rear surface layer tends to become larger by adjusting amounts of cross-linking agents, or amounts of molecules of polyol if the material of the rear surface layer is polyurethane.

However, the adjustment of the 100% permanent elongation is not limited to the method described above.

As a material used for the rear surface layer, polyurethane rubber, silicon rubber, fluoro-rubber, chloroprene rubber, butadiene rubber, or the like is used, for example. The polyurethane rubber is desirable from the above materials. As the polyurethane rubber, ester based polyurethane and ether based polyurethane are used, and ester based polyurethane is particularly desirable.

In addition, in a case of manufacturing the polyurethane rubber, there is a method using polyol and polyisocyanate.

As polyol, polytetramethylether glycol, polyethylene adipate, polycaprolactone or the like is used.

As polyisocyanate, 2,6-toluene diisocyanate (TDI), 4,4'-diphenyl methane diisocyanate (MDI), paraphenylene diisocyanate (PPDI), 1,5-naphthalene diisocyanate (MDI), 3,3-dimethyldiphenyl-4,4'-diisocyanate (TODI) or the like is used. Among them, MDI is desirable.

In addition, as a curing agent for curing polyurethane, a curing agent such as 1,4-butanediol or trimethylolpropane, ethylene glycol, or a mixture thereof is used.

To describe the exemplary embodiment with a detailed example, it is desirable that 1,4-butanediol and trimethylolpropane as curing agents be used with prepolymer generated by mixing and reacting diphenyl methane-4,4-diisocyanate with respect to polytetramethylether glycol subjected to a dewatering process. In addition, an additive such as a reaction conditioning agent may be added thereto.

As a method of manufacturing the rear surface layer, a well-known method of the related art is used according to raw materials used for the manufacturing, and for example, the member is prepared by forming and performing a cut process in a predetermined shape, using the centrifugal molding, the extrusion molding, or the like.

Manufacture of Cleaning Blade

In addition, the cleaning blade according to the exemplary embodiment is manufactured using a well-known molding method of the related art, and for example, may be manufactured by a so-called two-color molding method.

Herein, the manufacturing method thereof will be described using the cleaning blade 342 shown in FIGS. 1 to 3 as an example. First, a first mold including a cavity (region to which the composition for contacting layer molding flows) corresponding to a shape which is obtained by overlapping two contacting layers (edge members) 342A and the ventral surface 3C side each other, and a second mold including a cavity corresponding to a shape obtained by overlapping two of each contacting layer (edge member) 342A and rear surface layer (rear surface member) 342B, and the ventral surface 3C side each other, are prepared. A first molded material having a shape obtained by overlapping two contacting layers 342A each other is formed by pouring a composition for formation of the contacting layer into the cavity of the first mold and curing it. Then, after extracting the first mold, the second mold is installed so as to dispose the first molded material inside the cavity of the second mold. Next, a second molded material having a shape obtained by overlapping each contacting layer 342A and rear surface layer 342B with two of the ventral surface 3C side each other, is formed by pouring a composition for formation of the rear surface layer into the cavity of the second mold and curing so as to cover the first molded material. Then, by cutting the center of the formed second molded material, that is, the portion to be the ventral surface 3C, two of portions other than the supporting member (holder) 342C in the cleaning blade 342 shown in FIGS. 1 to 3 are formed. In addition, after the cutting, a step of further cutting for a predetermined dimension may be provided. After that, by adhering the supporting member (holder) 342C to the predetermined location, the cleaning blade 342 is manufactured.

In addition, a thickness of all portions of the contacting layer (edge member) and the rear surface layer (rear surface member) of the cleaning blade (that is, portion other than the supporting member (holder)) is desirable to be from 1.5 mm to 2.5 mm, and more desirable to be from 1.8 mm to 2.2 mm.

Supporting Member

As the supporting member (holder) 342C, the material is not particularly limited, and any well-known materials may be used, however, for example, as a material to be suitably used for the supporting member (holder) 342C, an electro-galvanized steel sheet or the like is used.

Purpose

When cleaning the member to be cleaned using the cleaning blade of the exemplary embodiment, as the member to be cleaned which is the target for cleaning, it is not particularly limited as long as it is a member of which a surface is necessary to be cleaned in the image forming apparatus. For example, an intermediate transfer body, a charging roller, a transfer roller, a transporting belt for material to be transferred, paper transporting roller, a cleaning brush for removing toner from an image holding member, a detoning roller for removing toner, and the like are exemplified, however, in the exemplary embodiment, the image holding member is particularly desirable.

Cleaning Device, Process Cartridge and Image Forming Apparatus

Next, a cleaning device, a process cartridge, and an image forming apparatus used with the cleaning blade of the exemplary embodiment will be described.

The cleaning device of the exemplary embodiment is not particularly limited as long as it includes the cleaning blade of the exemplary embodiment as a cleaning blade which comes in contact with a surface of a member to be cleaned and cleans the surface of the member to be cleaned. For example, as a configuration example of the cleaning device, a configuration, in which the cleaning blade is fixed so that an edge of the contacting layer (edge member) becomes an opening portion side in a cleaning case including an opening portion on a side of the member to be cleaned and a transporting member which guides foreign materials such as waste toner collected from the surface of the member to be cleaned by the cleaning blade to a foreign material collecting container is included, is used. In addition, two or more cleaning blades of the exemplary embodiment may be used in the cleaning device of the exemplary embodiment.

In a case of using the cleaning blade of the exemplary embodiment to clean the image holding member, in order to suppress an image deletion when forming an image, a force NF (Normal Force) to press the cleaning blade against the image holding member is desirably in a range from 1.3 gf/mm to 2.3 gf/mm, and more desirably in a range from 1.6 gf/mm to 2.0 gf/mm.

In addition, a length of a tip portion of the cleaning blade held in the image holding member is desirably in a range from 0.8 mm to 1.2 mm, and more desirably in a range from 0.9 mm to 1.1 mm.

An angle W/A (Working Angle) of the contacting portion of the cleaning blade and the image holding member is desirably in a range from 8° to 14°, and more desirably in a range from 10° to 12°.

Meanwhile, the process cartridge of the exemplary embodiment is not particularly limited as long as it includes the cleaning device of the exemplary embodiment as the cleaning device which comes in contact with surfaces of one or more members to be cleaned such as the image holding member, the intermediate transfer body, and the like and cleans the surfaces of the members to be cleaned, and for example, a process cartridge, that includes the image holding member and the cleaning device of the exemplary embodiment which cleans the surface of the image holding member and that is detachable with respect to the image forming apparatus, is exemplified. For example, as long as it is a so-called tandem machine including the image holding member corresponding to toner of each color, the cleaning device of the exemplary embodiment may be provided for each image holding member. In addition, other than the cleaning device of the exemplary embodiment, a cleaning brush or the like may be used together.

Detailed Examples of Cleaning Blade, Image Forming Apparatus, and Cleaning Device Next, detailed examples of the cleaning blade and image forming apparatus and the cleaning device using the cleaning blade of the exemplary embodiment will be described with reference to the drawing.

Figure 7:
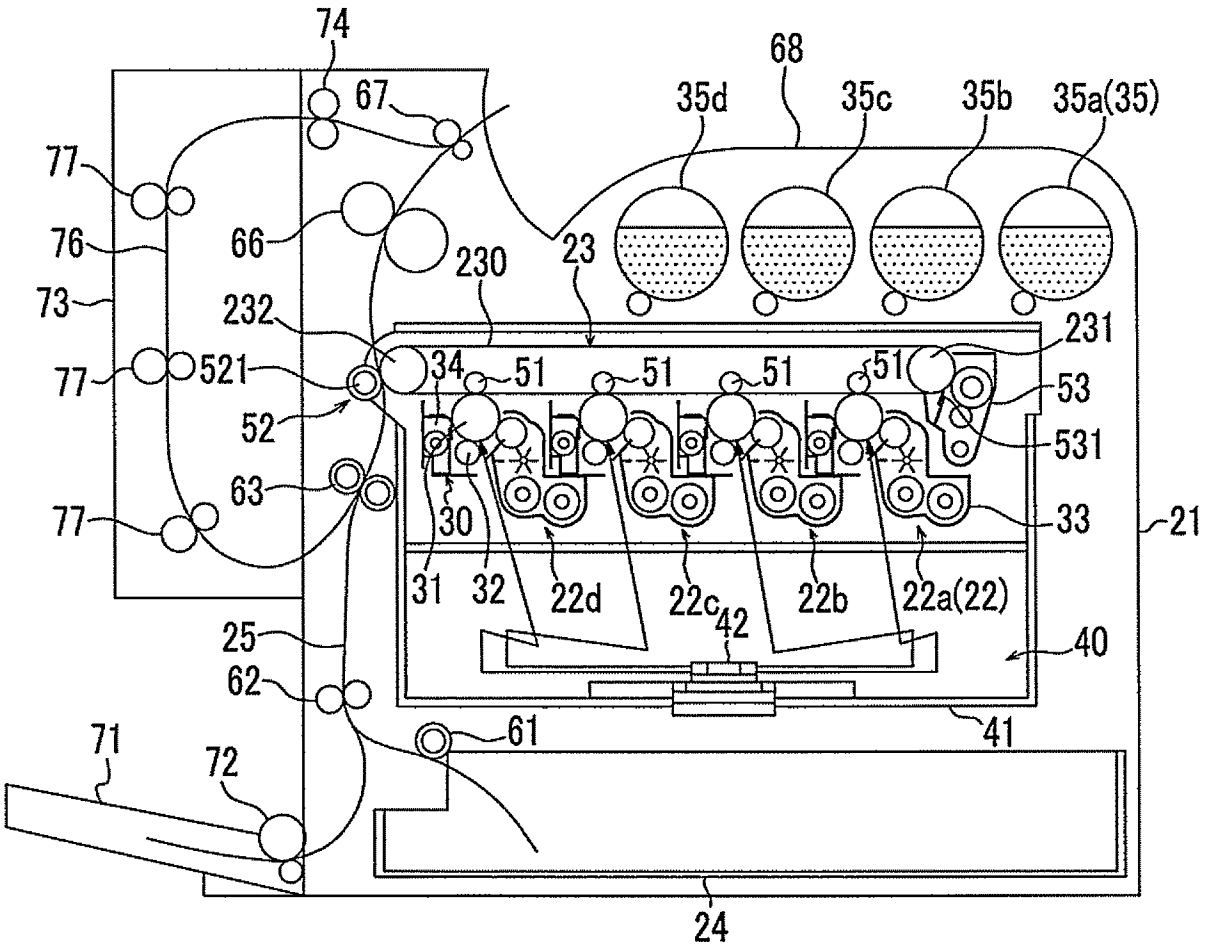
FIG. 7 is a schematic cross-sectional view showing an example of an image forming apparatus according to the exemplary embodiment.

FIG. 7 is a perspective schematic view showing an example of the image forming apparatus according to the exemplary embodiment, and shows a so-called tandem type image forming apparatus.

In FIG. 7, reference numeral 21 denotes a main housing, reference numerals 22 and 22*a* to 22*d* denote image forming engines, reference numeral 23 denotes a belt module, reference numeral 24 denotes a recording medium supply cassette, reference numeral 25 denotes a recording medium transporting path, reference numeral 30 denotes each photoreceptor unit, reference numeral 31 denotes a photoreceptor drum, reference numeral 33 denotes each developing unit, reference numeral 34 denotes a cleaning device, reference numerals 35 and 35*a* to 35*d* denote toner cartridges, reference numeral 40 denotes an exposing unit, reference numeral 41 denotes a unit case, reference numeral 42 denotes a polygon mirror, reference numeral 51 denotes a primary transfer unit, reference numeral 52 denotes a secondary transfer unit, reference numeral 53 denotes a belt cleaning device, reference numeral 61 denotes a sending-out roller and reference numeral 62 denotes a transporting roller, reference numeral 63 denotes a positioning roller, reference numeral 66 denotes a fixing device, reference numeral 67 denotes a discharge roller, reference numeral 68 denotes a paper discharge unit, reference numeral 71 denotes a manual feeder, reference numeral 72 denotes a sending-out roller, reference numeral 73 denotes a double side recording unit, reference numeral 74 denotes a guide roller, reference numeral 76 denotes a transporting path, reference numeral 77 denotes a transporting roller, reference numeral 230 denotes an intermediate transfer belt, reference numerals 231 and 232 denote support rollers, reference numeral 521 denotes a secondary transfer roller, and reference numeral 531 denotes a cleaning blade.

In the tandem type image forming apparatus shown in FIG. 7, the image forming engines 22 (in detail, 22*a* to 22*d*) with four colors (in the exemplary embodiment, black, yellow, magenta, and cyan) are arranged in the main housing 21, and on the upper portion thereof, the belt module 23 in which the intermediate transfer belt 230 which circulation-transports along the arrangement direction of each image forming engine 22 is included, is disposed. Meanwhile, the recording medium supply cassette 24, in which a recording medium (not shown), such as paper, is accommodated is disposed on the lower portion of the main housing 21, and the recording medium transporting path 25, which is a transporting path of the recording medium from the recording medium supply cassette 24, is disposed in a vertical direction.

In the exemplary embodiment, each image forming engine 22 (22*a* to 22*d*) forms toner images for black, yellow, magenta, and cyan (arrangement is not particularly limited to this order), in order from upstream in a circulation direction of the intermediate transfer belt 230, and includes each photoreceptor unit 30, each developing unit 33, and one common exposing unit 40.

Herein, each photoreceptor unit 30 obtains the photoreceptor drum 31, a charging device (charging roller) 32 which charges the photoreceptor drum 31 in advance, and the cleaning device 34 which removes remaining toner on the photoreceptor drum 31 integrally as sub-cartridges, for example.

In addition, the developing unit 33 develops an electrostatic latent image formed by exposing in the exposing unit 40 on the charged photoreceptor drum 31 with the corresponding colored toner (in the exemplary embodiment, for example, negative polarity), and configure the process cartridge (so-called customer replaceable unit) by being integrated with the sub-cartridge formed of the photoreceptor unit 30, for example.

Further, the process cartridge may also be used alone by separating the photoreceptor unit 30 from the developing unit 33. In addition, in FIG. 7, reference numerals 35 (35*a* to 35*d*)

are toner cartridges (toner supplying path is not shown) for supplying each color component toner to each developing unit 33.

Meanwhile, the exposing unit 40 is disposed to accommodate, for example, four semiconductor lasers (not shown), one polygon mirror 42, an imaging lens (not shown), and each mirror (not shown) corresponding to each photoreceptor unit 30 in the unit case 41, to scan light from the semiconductor laser for each color component with deflection by the polygon mirror 42, and to guide an optical image to an exposing point on the corresponding photoreceptor drum 31 through the imaging lens and mirrors.

In addition, in the exemplary embodiment, the belt module 23 includes the intermediate transfer belt 230 to bridge between a pair of support rollers (one roller is a driving roller) 231 and 232, and each primary transfer unit (in this example, primary transfer roller) 51 is disposed on the back surface of the intermediate transfer belt 230 corresponding to the photoreceptor drum 31 of each photoreceptor unit 30. Since a voltage having reverse polarity with charging polarity of toner is applied to the primary transfer unit 51, the toner image on the photoreceptor drum 31 electrostatically transfers to the intermediate transfer belt 230 side. Further, the secondary transfer unit 52 is disposed on a portion corresponding to the support roller 232 on the downstream of the image forming engine 22*d* which is on the most downstream of the intermediate transfer belt 230, and performs second transfer (collective transfer) of the first transfer image on the intermediate transfer belt 230 to a recording medium.

In the exemplary embodiment, the secondary transfer unit 52 includes the secondary transfer roller 521 which is disposed to be pressure-welded on the toner image holding surface side of the intermediate transfer belt 230, and a back surface roller (in this example, used with the support roller 232) which is disposed on the rear surface of the intermediate transfer belt 230 to be formed as an opposite electrode of the secondary transfer roller 521. In addition, for example, the secondary transfer roller 521 is grounded, and bias having the same polarity with the charging polarity of the toner is applied to the back surface roller (support roller 232).

In addition, the belt cleaning device 53 is disposed on the upstream of the image forming engine 22*a* which is on the most upstream of the intermediate transfer belt 230, and removes the remaining toner on the intermediate transfer belt 230.

In addition, the sending-out roller 61 which picks up a recording medium is disposed on the recording medium supply cassette 24, the transporting roller 62 which sends out the recording medium is disposed right behind the send-out roller 61, and a registration roller (positioning roller) 63 which supplies the recording medium to the secondary transfer portion at a predetermined timing is disposed on the recording medium transporting path 25 which positions in front of the secondary transfer portion. Meanwhile, the fixing device 66 is disposed on the recording medium transporting path 25 which is positioned on the downstream of the secondary transfer portion, the discharge roller 67 for discharge of the recording medium is disposed on downstream of the fixing device 66, and the discharge recording medium is accommodated in the discharge unit 68 formed on the upper portion of the main housing 21.

In addition, in the exemplary embodiment, the manual feeder (MSI) 71 is disposed on the side of the main housing 21, and the recording medium on the manual feeder 71 is sent towards the recording medium transporting path 25 through the sending-out roller 72 and the transporting roller 62.

In addition, the double side recording unit 73 is supplemented in the main housing 21. When a double side mode which performs image recording on double sides of a recording medium is selected, the double side recording unit 73 reverses a recording medium with the single side recorded by the discharge roller 67. And the discharge roller 67 brings the recording medium to the inner portion through the guide roller 74 in front of an inlet, brings back the recording medium in the inner portion through the transporting rollers 77, transports the recording medium along the transporting path 76, and supplies the recording medium to the positioning roller 63 side again.

Next, the cleaning device 34 which is disposed in the tandem type image forming apparatus shown in FIG. 7 will be described in detail.

Figure 8:
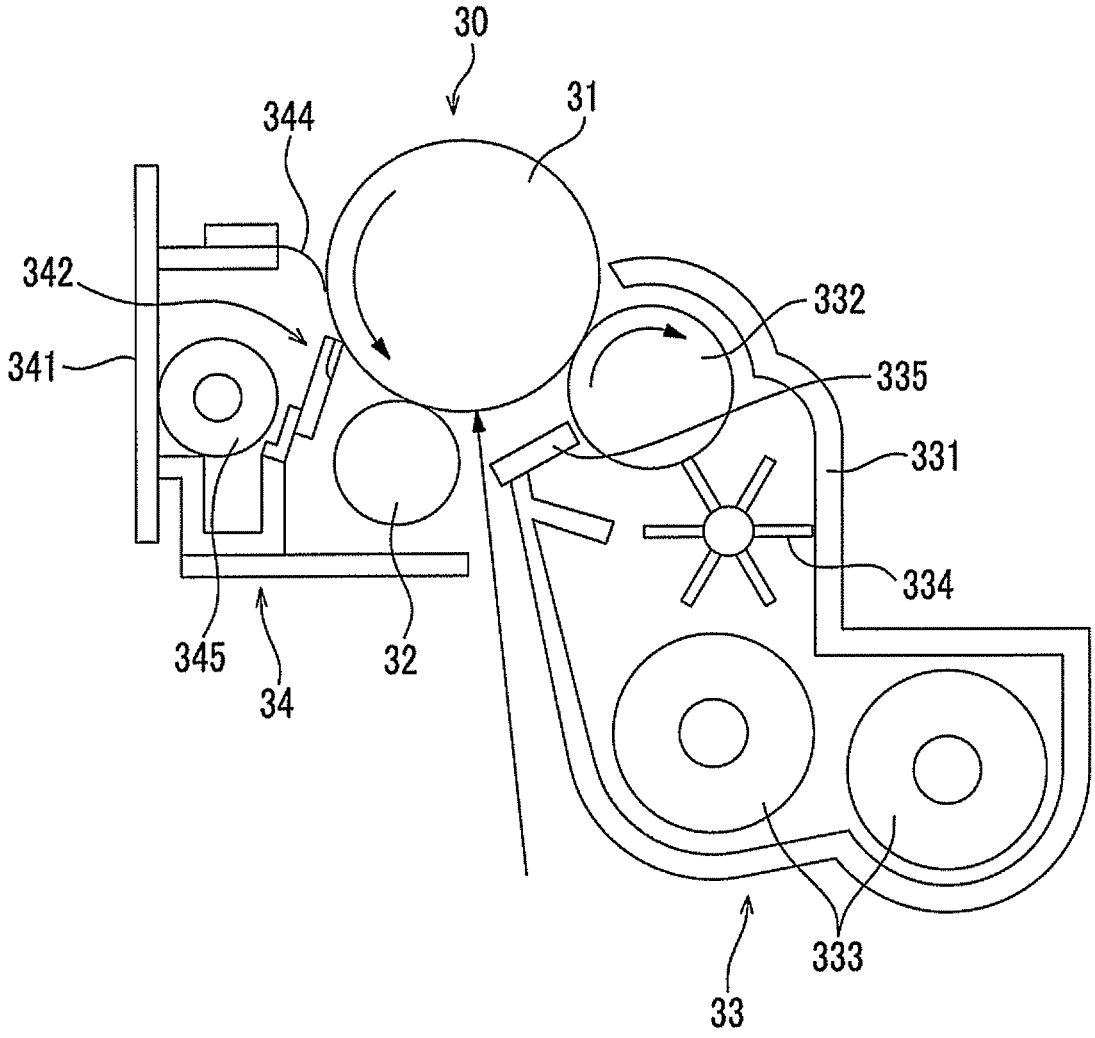
FIG. 8 is a schematic view of outline showing an example of a cleaning device according to the exemplary embodiment.

FIG. 8 is a schematic cross-sectional view showing an example of the cleaning device of the exemplary embodiment, and is a view showing the cleaning device 34, the photoreceptor drum 31 as the sub-cartridge, the charging roller 32, and the developing unit 33 shown in FIG. 7.

In FIG. 8, reference numeral 32 denotes the charging roller (charging device), reference numeral 331 denotes a unit case, reference numeral 332 denotes a developing roller, reference numerals 333 denote toner transporting members, reference numeral 334 is a transporting paddle, reference numeral 335 is a trimming member, reference numeral 341 denotes a cleaning case, reference numeral 342 denotes a cleaning blade, reference numeral 344 denotes a film seal, and reference numeral 345 denotes a transporting member.

The cleaning device 34 includes the cleaning case 341 which accommodates the remaining toner and which is open facing the photoreceptor drum 31, and in the cleaning device 34, the cleaning blade 342 which is disposed to come in contact with the photoreceptor drum 31 is attached to the lower edge of the opening of the cleaning case 341 through a bracket (not shown). Meanwhile, the film seal 344 which is held air tightly with respect to the photoreceptor drum 31 is attached to the upper edge of the opening of the cleaning case 341. In addition, reference numeral 345 denotes a transporting member which guides waste toner accommodated in the cleaning case 341 to a waste toner container on the side.

In addition, in the exemplary embodiment, in all cleaning devices 34 of respective image forming engines 22 (22*a* to 22*d*), the cleaning blade of the exemplary embodiment is used as the cleaning blade 342, and the cleaning blade of the exemplary embodiment may be used for the cleaning blade 531 used in the belt cleaning device 53.

In addition, as shown in FIG. 8, for example, the developing unit (developing device) 33 used in the exemplary embodiment includes the unit case 331 which accommodates a developer and opens facing the photoreceptor drum 31. Herein, the developing roller 332 is disposed on the portion which faces the opening of the unit case 331, and toner transporting members 333 for stirring and transporting of the developer are disposed in the unit case 331. Moreover, the transporting paddle 334 may be disposed between the developing roller 332 and the toner transporting member 333.

When developing, after supplying the developer to the developing roller 332, the developer is transported to a developing area facing the photoreceptor drum 31 in a state where the layer thickness of the developer is regulated in the trimming member 335, for example.

In the exemplary embodiment, as the developing unit 33, a two-component developer formed of toner and a carrier for example, is used, however, a one-component developer formed only of the toner may be used.

Next, an operation of the image forming apparatus according to the exemplary embodiment will be described. First, when respective image forming engines 22 (22*a* to 22*d*) form single-colored toner images corresponding to each color, the single-colored toner images of each color are sequentially superimposed so as to match with original document information and subjected to primary transfer to the surface of the intermediate transfer belt 230. Next, the colored toner images transferred to the surface of the intermediate transfer belt 230 is transferred to the surface of the recording medium in the secondary transfer unit 52, and the recording medium to which the colored toner image is transferred is subjected to a fixing process by the fixing device 66, and then, is discharged to the paper discharge unit 68.

Meanwhile, in the respective image forming engines 22 (22*a* to 22*d*), the remaining toner on the photoreceptor drum 31 is cleaned by the cleaning device 34, and the remaining toner on the intermediate transfer belt 230 is cleaned by the belt cleaning device 53.

In such image forming process, each remaining toner is cleaned by the cleaning device 39 (or belt cleaning device 53).

In addition, the cleaning blade 342 may be fixed with a spring material, other than being directly fixed with a frame member in the cleaning device 34 as shown in FIG. 8.

EXAMPLES

Hereinafter, Examples of the invention will be described in detail, however the invention is not limited only to the following examples. In addition, in the description below, a "part" refers to a "part by weight".

A: Relationship Between Dynamic Ultra Microhardness and Scrape of Toner

Comparative Example A1

Cleaning Blade A1

A cleaning blade A1 shown in FIGS. 1 to 3 in which the shape of the contacting layer (edge member) from the side view side gradually approaches from the tip surface to the ventral surface side in the longitudinal direction in arc shape, is manufactured by the two-color molding method.

Preparation of Mold

First, a first mold including a cavity (region to which the composition for contacting layer molding flows) corresponding to a shape which is obtained by overlapping two contacting layers (edge members) and the ventral surface side each other, and a second mold including a cavity corresponding to a shape obtained by overlapping two of each contacting layer and rear surface layer (rear surface member), and the ventral surface side each other, are prepared.

Formation of Contacting Layer (Edge Member)

First, polycaprolactone polyol (PLACCEL 205 manufactured by Daicel Corporation with an average molecular weight of 529 and a hydroxyl value of 212 KOHmg/g) and polycaprolactone polyol (PLACCEL 240 manufactured by Daicel Corporation with an average molecular weight of 4155 and a hydroxyl value of 27 KOHmg/g) are used as the soft segment materials of polyol components. In addition, the soft segment materials and the hard segment materials are mixed with a ratio of 8:2 (weight ratio) by using the acrylic resin including two or more hydroxyl groups (ACTFLOW UMB-2005B manufactured by Soken Chemical & Engineering Co., Ltd.) as the hard segment material.

Next, 6.26 parts of 4,4'-diphenyl methane diisocyanate (MILLIONATE MT manufactured by Nippon Polyurethane Industry Co., Ltd.) as the isocyanate compound is added to 100 parts of the mixture of the soft segment materials and the hard segment materials, and the resultant mixture is reacted under a nitrogen atmosphere at 70° C. for three hours. In addition, the amount of the isocyanate compound used for this reaction is selected so that a ratio (isocyanate groups/hydroxyl group) of the isocyanate groups with respect to the hydroxyl group included in a reaction system becomes 0.5.

Next, 34.3 parts of the isocyanate compounds are further added thereto, and the resultant mixture is reacted under a nitrogen atmosphere at 70° C. for three hours, and prepolymer is obtained. In addition, the entire amounts of the isocyanate compounds used when using the prepolymer are 40.56 parts.

Next, the temperature of the prepolymer is increased to 100° C., and subjected to defoaming for one hour under the reduced pressure. After that, 7.14 parts of mixture (weight ratio=60/40) of 1,4-butanediol and trimethylolpropane are added to 100 parts of prepolymer and mixed for three minutes without foaming, and a composition A1 for contacting layer formation is prepared.

Next, the composition A1 for contacting layer formation is poured into the centrifugal molding machine by which a first mold is adjusted at 140° C., and subjected to the curing reaction for one hour. Next, the composition is cross-linked at 110° C. for 24 hours, and cooled to form a first molded material having a shape obtained by overlapping two contacting layers.

Formation of Rear Surface Layer (Rear Surface Member)

A material in which 1,4-butanediol and trimethylolpropane are used as curing agents with prepolymer generated by mixing diphenyl methane-4,4-diisocyanate with respect to polytetramethylether glycol subjected to a dewatering process and reacting at 120° C. for 15 minutes, is used as a composition A1 for rear surface layer formation.

Then, a second mold is installed in the centrifugal molding machine so as to dispose the first molded material inside the cavity of the second mold, the composition A1 for rear surface layer formation is poured into the cavity of the second mold which is adjusted to 140° C. so as to cover the first molded material, is subjected to the curing reaction for 1 hour, and a second molded material having a shape obtained by overlapping two ventral surface sides of each contacting layer and rear surface layer, is formed.

After forming the second molded material, it is cross-linked and cooled at 110° C. for 24 hours. Then, by cutting the second molded material after cross linking in a portion to be a ventral surface, and further cutting to have a dimension with a length of 8 mm and a thickness of 2 mm, a rubber portion (portion other than the supporting member (holder)) of the cleaning blade is obtained.

Adhesion of Supporting Member (Holder)

The supporting member (holder) made of an electrogalvanized steel sheet is adhered to a predetermined position of the obtained rubber member on the rear surface side by the adhesive, and the cleaning blade A1 is obtained.

In addition, the physical property values of the contacting layer (edge member) are as follows when measuring with the method described above.

Longitudinal direction maximum length (T): 0.4 mm

Longitudinal direction maximum length (W): 3.0 mm

Ratio (T/W): 0.13

Range where the ratio (T/W) of the cleaning contribution region satisfies the numerical value: 100%

Dynamic ultra microhardness: 0.14

10° C. impact resilience: 40%

Further, the physical property values of the rear surface layer (rear surface member) and the entire blade are as follows when measuring with the method described above.

Blade free length: 8.0 mm

Dynamic ultra microhardness: 0.07

50° C. impact resilience: 30%

Permanent elongation: 0.9%

Examples A1 to A9 and Comparative Examples A2 and A3

Cleaning blades having dynamic ultra microhardness of the contacting layer (edge member) different from Comparative Example A1 are manufactured.

In detail, cleaning blades A2 to A15 are obtained with the method described for Comparative Example A1, except for adjusting the dynamic ultra microhardness so as to obtain values as shown in Table 1 below by changing amount of hard segments, in formation of the contacting layer (edge member) of Comparative Example A1.

Evaluation Test: Toner Scrape Evaluation

With the method described below, a degree of toner scrape, due to variance of the dynamic ultra microhardness, that is, cleaning performance is evaluated.

Cleaning blades in Examples and Comparative Examples obtained as described above are loaded on DocuCentre-IV 05575 manufactured by Fuji Xerox co., Ltd., NF (Normal Force) is adjusted to 1.3 gf/mm and W/A (Working Angle) at 11°, and then 10000 sheets are printed.

If the toner scrapes through the contacting region of a cleaning blade and a photosensitive drum, the toner is accumulated on the ventral surface of the cleaning blade. Accordingly, the amount of toner accumulated on the ventral surface of the cleaning blade which is subjected to the test is measured. In addition, it is determined that the accumulated amount is suitable to be equal to or less than $15.0\times10^{-3}$ mm$^3$. The results are shown in Table 1 below.

TABLE 1

| | | Dynamic ultra microhardness | Accumulated amount of toner [$\times10^{-3}$ mm$^3$] |
|---|---|---|---|
| Examples | A1 | 0.25 | 15 |
| | A2 | 0.3 | 10 |
| | A3 | 0.32 | 8 |
| | A4 | 0.33 | 7 |
| | A5 | 0.4 | 6 |
| | A6 | 0.48 | 6 |
| | A7 | 0.49 | 7 |
| | A8 | 0.59 | 8 |
| | A9 | 0.65 | 15 |
| Comparative Examples | A1 | 0.14 | 31 |
| | A2 | 0.21 | 20 |
| | A3 | 0.73 | 21 |

Figure 9:
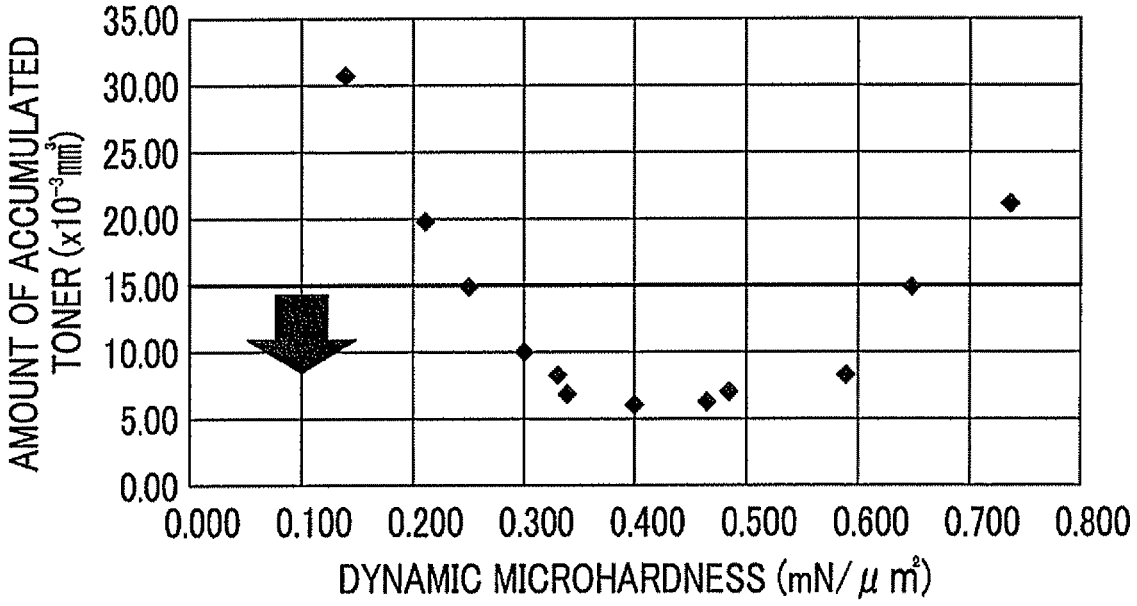
FIG. 9 is a graph showing a result of amounts of accumulated toner in Example A.

In addition, FIG. 9 shows the results in a graph.

B: Relationship Between Ratio (T/W) and Magnitude of Vibration

Examples and Comparative Examples

Example B1

A cleaning blade B1 is obtained with the method described for Example A2, except for changing the longitudinal direction maximum length (T) and the longitudinal direction maximum length (W) to change the ratio (T/W) as follows, in formation of the contacting layer (edge member) of Example A2.

In addition, the physical property values of the contacting layer (edge member) are as follows when measuring with the method described above.

Longitudinal direction maximum length (T): 0.4 mm

Longitudinal direction maximum length (W): 1.2 mm

Ratio (T/W): 0.33

Range where the ratio (T/W) of the cleaning contribution region satisfies the numerical value: 100%

Dynamic ultra microhardness: 0.3

10° C. impact resilience: 40%

Further, the physical property values of the rear surface layer (rear surface member) and the entire blade are as follows when measuring with the method described above.

Blade free length: 8 mm

Dynamic ultra microhardness: 0.07

50° C. impact resilience: 30%

Permanent elongation: 0.9%

Examples B2 to B13 and Comparative Examples B1 to B4

Cleaning blades are obtained with the method described for Example B1, except for changing the longitudinal direction maximum length (T) and the longitudinal direction maximum length (W) to change the ratio (T/W) as shown in the following Table 2, in formation of the contacting layer (edge member) of Example B1.

TABLE 2

| | | Ratio (T/W) | | | |
|---|---|---|---|---|---|
| | | Longitudinal direction maximum length (W) | | | |
| | | 1.2 mm | 2.2 mm | 3.2 mm | 5.2 mm |
| Longitudinal direction maximum length (T) | 0.9 mm | | Comparative example B3 0.41 | Example B5 0.28 | Example B10 0.17 |
| | 0.8 mm | | Comparative example B4 0.36 | | |
| | 0.7 mm | Comparative example B1 0.58 | Example B3 0.32 | Example B6 0.22 | Example B11 0.13 |

TABLE 2-continued

| Ratio (T/W) | | | | |
|---|---|---|---|---|
| | Longitudinal direction maximum length (W) | | | |
| | 1.2 mm | 2.2 mm | 3.2 mm | 5.2 mm |
| 0.5 mm | Comparative example B2 0.42 | 0.23 | 0.16 | 0.10 |
| 0.4 mm | Example B1 0.33 | | Example B8 0.13 | |
| 0.3 mm | Example B2 0.25 | | Example B9 0.09 | Example B13 0.06 |

Evaluation Test: Vibratory Evaluation

The magnitude of the vibration to be generated in the cleaning blade is calculated from various physical property values described above of the contacting layer (edge member) and the rear surface layer (rear surface member), the values of the conditions when mounting the cleaning blade to a device, or the like, with simulation.

Figure 10:
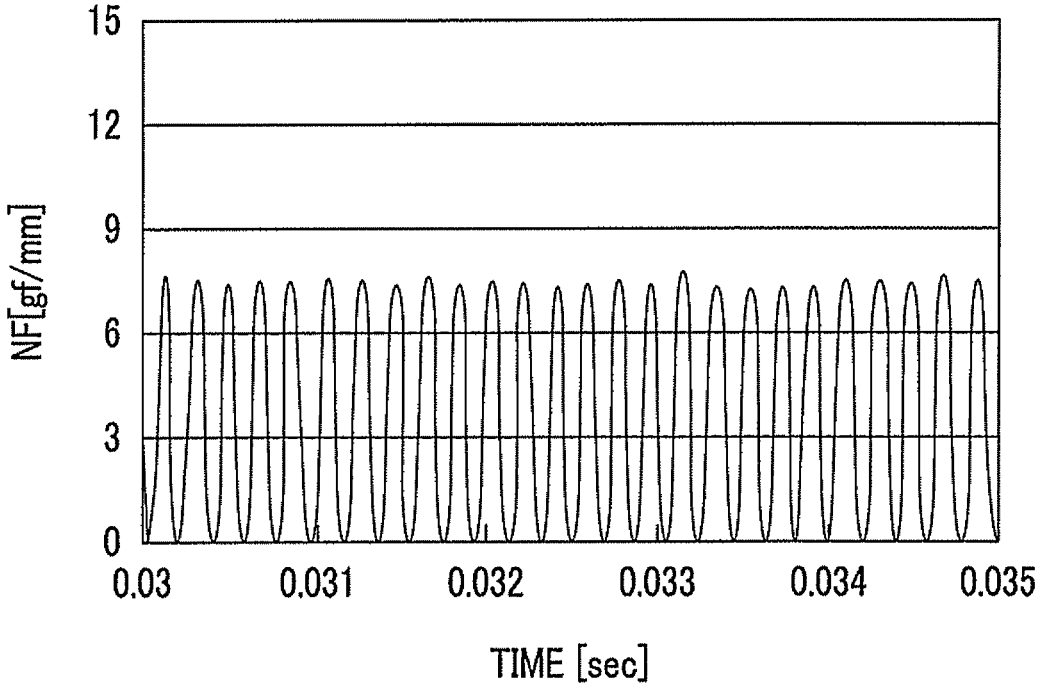
FIG. 10 is a graph showing a result of magnitude of vibration in Comparative Example B4.
Figure 11:
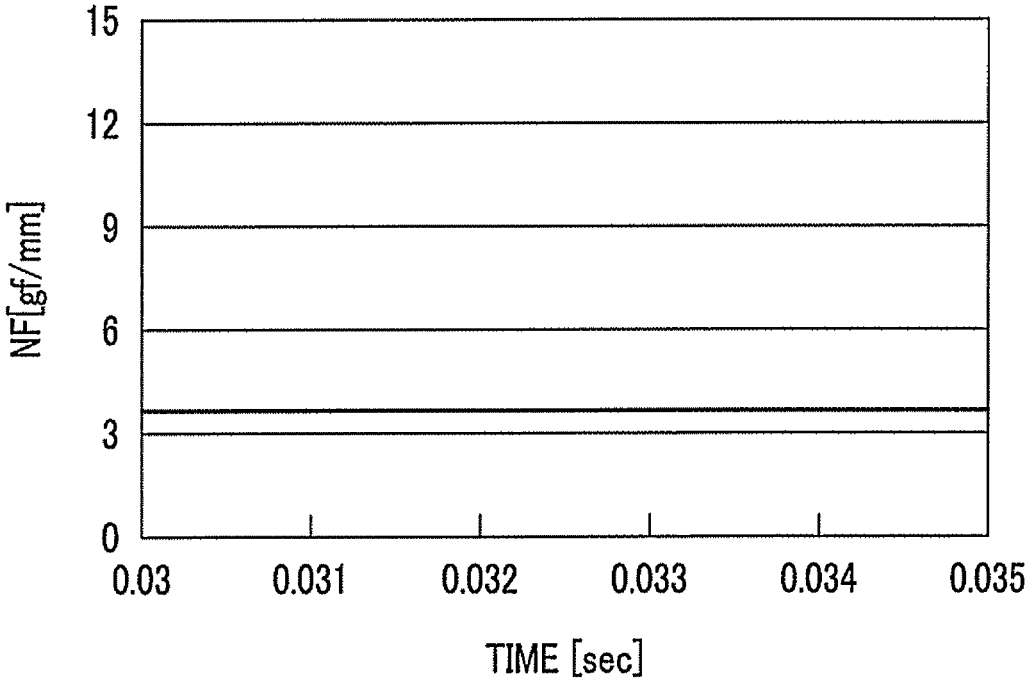
FIG. 11 is a graph showing a result of magnitude of vibration in Example B3.

The obtained results are shown in Table 3 below. In addition, graphs showing the measurement results of the magnitude of the vibration in Comparative Example B4 (ratio (T/W)=0.36) and the measurement results of the magnitude of the vibration in Example B3 (ratio (T/W)=0.32) are shown in FIG. 10 and FIG. 11, respectively.

TABLE 3

| Magnitude of vibration | | | | | |
|---|---|---|---|---|---|
| | | Longitudinal direction maximum length (W) | | | |
| | | 1.2 mm | 2.2 mm | 3.2 mm | 5.2 mm |
| Longitudinal direction maximum length (T) | 0.9 mm | | Comparative example B3 2.969216 | Example B5 0.004459 | Example B10 0.027089 |
| | 0.8 mm | | Comparative example B4 2.759161 | | |
| | 0.7 mm | Comparative example B1 2.996704 | Example B3 0.01104 | Example B6 0.004171 | Example B11 0.015735 |
| | 0.5 mm | Comparative example B2 2.67397 | Example B4 0.002621 | Example B7 0.003988 | Example B12 0.021022 |
| | 0.4 mm | Example B1 0.001526 | | Example B8 0.003751 | |
| | 0.3 mm | Example B2 0.001522 | | Example B9 0.003643 | Example B13 0.013384 |

Evaluation Test: Toner Scrape Evaluation

The following test is executed for the cleaning blades of Example B4, Example B12, Comparative Example B2, and Comparative Example B3, and a degree of toner scrape, that is, cleaning performance is evaluated. Each cleaning blade is mounted on DocuCentre-IV C5575 manufactured by Fuji Xerox co., Ltd., and 10k sheets are printed.

When introducing the non-transfer toner of 300 mm and shutting down at that time, a degree of the toner scrape remaining on the surface of photoreceptor after passing the cleaning blade is evaluated.

In addition, evaluation criteria are as follows.

A: No scrapes

B: Several slight scrapes with stripes

C: Several tens of scrapes with stripes

D: Scrapes almost over entire surface in the axis direction

The results thereof are as follows.

Example B4 (T: 0.5 mm, W: 2.2 mm): "A"

Example B12 (T: 0.5 mm, W: 5.2 mm): "A"

Comparative Example B2 (T: 0.5 mm, W: 1.2 mm): "C"

Comparative Example B3 (T: 0.9 mm, W: 2.2 mm): "D"

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning blade comprising:

a contacting corner portion which comes in contact with and cleans a surface of a member to be cleaned moving relative to the cleaning blade;

a tip surface which configures one side with the contacting corner portion and faces an upstream side of the surface moving direction;

a ventral surface which configures one side with the contacting corner portion and faces a downstream side; and a rear surface which shares one side with the tip surface and opposes the ventral surface, wherein, when a direction parallel with the contacting corner portion is set as a short direction, a direction of a side formed from the contacting corner portion to the tip surface is set as a first longitudinal direction, and a direction of a side formed from the contacting corner portion to the ventral surface is set as a second longitudinal direction, the cleaning blade further comprises:

a contacting layer which configures a portion including the contacting corner portion, and in which (i) a region where a ratio (T/W) of a first longitudinal direction maximum length (T) and a second longitudinal direction maximum length (W) satisfies a relationship equal to or less than 0.35, (ii) is equal to or more than 95% in a region contributing for cleaning in the short direction, (iii) dynamic ultra microhardness is from 0.25 to 0.65, and (iv) an endothermic peak top temperature is equal to or higher than 180° C., a rear surface layer which covers the rear surface side of the contacting layer in the longitudinal direction and the side opposite to the tip surface in the longitudinal direction and is formed of a material different from the contacting layer, and a supporting member which is adhered to the rear surface and is disposed so that a length from an end portion on the tip surface side in the adhered state to an end portion of the rear surface on the tip surface side is longer than the maximum length of the contacting layer in the longitudinal direction.

2. A cleaning device comprising:

the cleaning blade according to claim 1.

3. A process cartridge comprising:

the cleaning device according to claim 2, wherein the process cartridge is detachable with respect to an image forming apparatus.

4. An image forming apparatus comprising:

an image holding member;

a charging device which charges the image holding member;

an electrostatic latent image forming device which forms an electrostatic latent image on a surface of the charged image holding member;

a developing device which develops the electrostatic latent image formed on the surface of the image holding member with toner to form a toner image;

a transfer device which transfers the toner image formed on the image holding member on a recording medium; and the cleaning device according to claim 2 which brings the cleaning blade into contact with the surface of the image holding member after the transfer of the toner image by the transfer device for cleaning.

* * * * *